US005511292A

United States Patent [19]

Covi et al.

[11] Patent Number: 5,511,292

[45] Date of Patent: Apr. 30, 1996

[54] ZIPPER CLOSURE

[75] Inventors: Christian Covi, Fritzens; Werner Steinlechner, Jenbach, both of Austria

[73] Assignee: D. Swarovski & Co., Wattens, Austria

[21] Appl. No.: 496,217

[22] Filed: Jun. 28, 1995

[51] Int. Cl.[6] ..... A44B 19/00

[52] U.S. Cl. ..... 24/410; 24/403; 24/433

[58] Field of Search ..... 24/410, 403, 433, 24/404, 405, 415, 417, 419, 429, 431, 439

[56] References Cited

U.S. PATENT DOCUMENTS

| | | | |
|---|---|---|---|
| 2,495,033 | 1/1950 | Sullivan | 24/410 |
| 2,644,995 | 7/1953 | Morin | 24/410 |
| 3,825,978 | 7/1974 | Sakalys | 24/410 |
| 4,441,235 | 4/1984 | Kusayama | 24/410 |

FOREIGN PATENT DOCUMENTS

| | | | |
|---|---|---|---|
| 0101510 | 7/1937 | Australia | 24/403 |
| 183046 | 2/1955 | Austria . | |
| 2304341 | 9/1973 | Germany . | |

*Primary Examiner*—Victor N. Sakran

*Attorney, Agent, or Firm*—Wenderoth, Lind & Ponack

[57] ABSTRACT

The invention relates to a zipper closure comprising a first and second row of teeth formed on a first and second band, each band comprising an edge bead or web, said teeth having free ends, each of which with a channel formed therein, when said zipper closure being closed said free ends of said first row of teeth extending into an area of attachment of said teeth of said second row of teeth and vice versa, whereby said channels receive said edge beads or webs, the zipper closure further comprising a slider with a top cover plate and a bottom cover plate connected by a cross-piece, said slider having a wider front end and a narrower back end, said cross-piece having a front end directed towards said wider front end of said slider and a back end directed towards said narrower back end of said slider. According to a first aspect of the invention said cross-piece is comprising a tapered projection extending beyond said back end of said cross-piece and directed towards said narrower back end of said slider, whereby on opening of the zipper closure said projection engages in said channels of said teeth and an outwardly directed force is exerted onto said teeth. According to a second aspect of the invention said front end of said cross-piece directed towards said wider front end of said slider is converging to an edge.

2 Claims, 2 Drawing Sheets

ZIPPER CLOSURE

This invention relates to a zipper closure comprising a first and second row of teeth formed on a first and second band, each comprising an edge bead or web, said teeth having free ends each with a channel formed therein, when said zipper closure being closed said free ends of said first row of teeth extending into an area of attachment of said teeth of said second row of teeth and vice versa, whereby said channels receive said edge beads or webs, the zipper closure further comprising a slider with a top cover plate and a bottom cover plate connected by a cross piece, said slider having a wider front end and a narrower back end, said cross-piece having a front end directed towards said wider front end of said slider and a back end directed towards said narrower back end of said slider.

A zipper closure of that kind is for example known from DE-OS No. 23 04 341. As the successive teeth of the zipper closure overlap practically over their entire lengths, it is relatively difficult to open the zipper closure. In order to exert an opening force onto the critical region of the zipper closure, it has already been suggested to provide the bands with a second bead or web, which slides along the outer surface of the slider, whereby the bands are pulled apart by the widening of the slider between its back end and its front end.

Another drawback in prior art zipper closures is related to the fact that they normally cannot be closed completely, i.e. the last few teeth towards the end of the zipper closure at which the bands are connected together cannot be closed.

It is a first object of the invention to improve a zipper closure of the type mentioned at the outset by designing the slider itself in a way that in the moment of opening a tooth of the zipper closure a force is exerted onto the tooth of the zipper closure in the direction of its opening.

According to the invention this is achieved in that the cross-piece of the slider is comprising a tapered projection extending beyond said back end of said cross-piece and directed towards said narrower back end of said slider, whereby on opening of the zipper closure said projection engages in said channels of said teeth and an outwardly directed force is exerted onto said teeth.

Another object of the invention is to improve the closing of a zipper closure of the type mentioned at the outset.

According to the invention this is achieved in that the front end of the cross piece which is directed towards the wider front end of the slider is converging to an edge.

By this, also teeth lying close to the end of the zipper closure at which the bands are connected together can be closed.

Details of the invention are explained with reference to the accompanying drawings.

DETAILED DESCRIPTION OF THE PREFERRED EMBODIMENT

Figure 1:
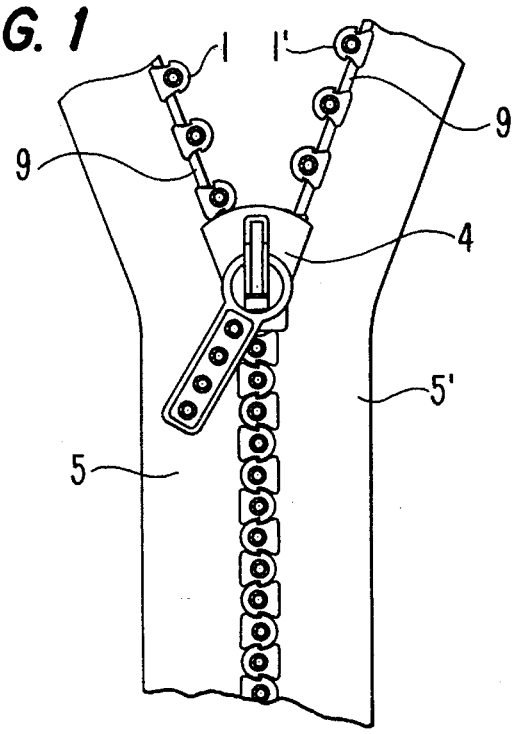
FIG. 1 is a top or elevation view of a zipper closure.

The zipper closure shown in FIG. 1 comprises two bands 5,5', on which teeth, 1,1' are arranged offset in the longitudinal direction. Edge beads or webs 9,9' of the bands 5,5' serve to support teeth 1, and teeth 1,1' are attached to beads or webs 9,9' by injection molding during production thereof. Decorative stones 3, for example made of lead crystal, are molded at the same time. A slider 4 typically serves to open and close the zipper closure.

Figure 2:
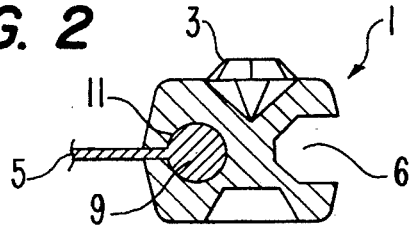
FIG. 2 is an enlarged longitudinal section through a tooth.
Figure 3:
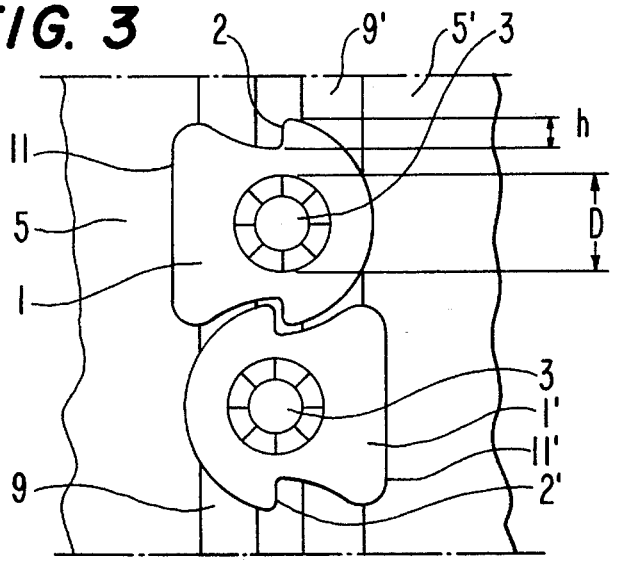
FIG. 3 is an enlarged top view of two adjacent teeth.

As evident from FIGS. 2 and 3, contact areas of the teeth 1,1' confronting and abutting one another in the closed position are designed prismatically, such that the areas of contact encounter no resistance to a vertical shifting of the teeth relative to one another (i.e. shifting in an direction perpendicular to the plane of FIG. 3), aside from the friction. The anchoring of the teeth 1,1' normal to the plane of the bands 5,5' results thus that the channels 6,6' formed in free ends of the teeth 1,1' receive the beads or webs 9,9' of the opposing band 5,5'. So that this is possible, the teeth 1,1' must have a length which approximately corresponds to the width of the closed zipper closure. Each tooth 1,1' converges, in elevation or top view, starting from a base 11,11' to a narrowest area or portion thereof, from which support surfaces 2,2' extend outwardly nearly parallel to bands 5,5'. The free end of each tooth 1,1' has approximately the form of a half ellipse.

Decorative stones 3 can be arranged in a straight line and at a narrow spacing in comparison to their size, when the support surfaces 2,2' are kept correspondingly small, which in turn is possible due to their extension at a sharp angle to the direction of the teeth 1,1'. In the illustrated embodiment, the extension h of each support surface 2,2' in the direction of the bands 5,5' amounts to about a third of the diameter D of the decorative stones 3. In this way each decorative stone 3 is surrounded by a satisfactory amount of plastic material of the respective tooth, and still the distance between the stones 3 in a row with one another is significantly smaller than their diameter.

Figure 4:
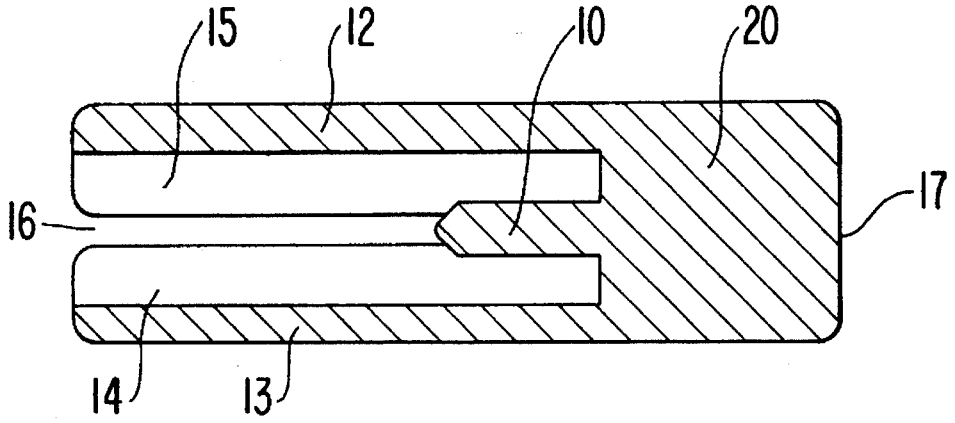
FIG. 4 is an enlarged vertical longitudinal section through a slider.

The slider is shown in a longitudinal section in FIG. 4 and comprises top and bottom cover plates 12 and 13, respectively. Both of the side walls of the slider comprise upper and lower parts 15 and 16, respectively, which are divided by slits 16 along their full lengths. The bands 5,5' run through the slits 16, and the beads or webs 9,9' are supported by the inner surfaces of the upper and lower parts 15,16 of the side walls. A cross-piece 20 connects the top cover plate 12 with the bottom cover plate 12.

For opening the zipper closure an outwardly directed force has to be exerted onto the teeth 1,1'. For this purpose, the cross-piece 20 is provided with a projection 10 which, having the form of a lance tip, extends beyond the end of the cross-piece 20 in the direction of the narrower end of the slider. On opening of the zipper closure this projection 10 engages in the channels 6,6' of the teeth 1,1' and in this way presses them into the tracks lying on both sides of the cross-piece 20 and extending to the wider end of the slider.

In prior art zipper closures, the end of the cross-piece 20 directed towards the wider end of the slider is formed truncated, whereby the teeth 1,1' have a considerable distance from each other at this place. In contrast thereto, to allow as complete as possible closing of the zipper closure of the present invention, the end of the cross-piece 20 directed towards the wider end of the slider converges to an edge 17.

We claim:

1. A zipper closure comprising a first and second row of teeth formed on a first and second band, each band comprising an edge bead or web, said teeth having free ends, each of which with a channel formed therein, when said zipper closure being closed said free ends of said first row of teeth extending into an area of attachment of said teeth of said second row of teeth and vice versa, whereby said channels receive said edge beads or webs, the zipper closure further comprising a slider with a top cover plate and a bottom cover plate connected by a cross-piece, said slider having a wider front end and a narrower back end, said cross-piece having a front end directed towards said wider front end of said slider and a back end directed towards said narrower back end of said slider, wherein said cross-piece is comprising a tapered projection extending beyond said back end of said cross-piece and directed towards said narrower back end of said slider, whereby an opening of the zipper closure said projection engages in said channels of said teeth and an outwardly directed force is exerted onto said teeth.

2. A zipper closure comprising a first and second row of teeth formed on a first and second band, each band comprising an edge bead or web, said teeth having free ends, each of which with a channel formed therein, when said zipper closure being closed said free ends of said first row of teeth extending into an area of attachment of said teeth of said second row of teeth and vice versa, whereby said channels receive said edge beads or webs, the zipper closure further comprising a slider with a top cover plate and a bottom cover plate connected by a cross-piece, said slider having a wider front end and a narrower back end, said cross-piece having a front end directed towards said wider front end of said slider and a back end directed towards said narrower back end of said slider, wherein said front end of said cross-piece directed towards said wider front end of said slider is converging to an edge.

* * * * *

UNITED STATES PATENT AND TRADEMARK OFFICE

CERTIFICATE OF CORRECTION

PATENT NO. : 5,511,292
DATED : April 30, 1996
INVENTOR(S) : Covi et al.

It is certified that error appears in the above-identified patent and that said Letters Patent is hereby corrected as shown below:

Please delete columns 1-4 and substitute columns 1-4 as per attached.

Signed and Sealed this

Seventh Day of July, 1998

Bruce Lehman

*Attest:*

BRUCE LEHMAN

*Attesting Officer*

*Commissioner of Patents and Trademarks*

ZIPPER CLOSURE

BACKGROUND OF THE INVENTION

This invention relates to a zipper closure including first and second rows of teeth formed on first and second bands, each band having an edge bead or web, and the teeth having free ends each with a channel formed therein. When the zipper closure is being closed the free ends of said first row of teeth extend into an area of attachment of the teeth of the second row of teeth and vice versa whereby the channels receive the edge beads or webs. The zipper closure further includes a slider with a top cover plate and a bottom cover plate connected by a cross piece. The slider has a wider front end and a narrower back end and the cross-piece has a front end directed towards the wider front end of the slider and a back end directed towards the narrower back end of the slider.

A zipper closure of such kind is, for example, known from DE-OS No. 23 04 341. As successive teeth of the zipper closure overlap practically over their entire lengths, it is relatively difficult to open the zipper closure. In order to exert an opening force onto the critical region of the zipper closure, it has already been suggested to provide the bands with second beads or webs, which slide along the outer surface of the slider, whereby the bands are pulled apart by the widening of the slider between its back end and its front end.

Another drawback in prior art zipper closures is related to the fact that they normally cannot be closed completely, i.e. the last few teeth towards the end of the zipper closure at which the bands are connected together cannot be closed.

SUMMARY OF THE INVENTION

It is a first object of the invention to improve a zipper closure of the type mentioned above by designing the slider itself in a way that at the moment of opening a tooth of the zipper closure a force is exerted onto the tooth of the zipper closure in the direction of its opening.

According to the invention this is achieved in that the cross-piece of the slider includes a tapered projection extending beyond the back end of the cross-piece and directed towards the narrower back end of said slider, whereby on opening of the zipper closure the projection engages in said channels of said teeth and an outwardly directed force is exerted on the teeth.

Another object of the invention is to improve the closing of a zipper closure of the type mentioned above.

According to the invention this is achieved in that the front end of the cross-piece which is directed towards the wider front end of the slider converges to an edge.

By this, also teeth lying close to the end of the zipper closure at which the bands are connected together can be closed.

Details of the invention are explained below with reference to the accompanying drawings.

BRIEF DESCRIPTION OF THE DRAWINGS

FIG. 1 is a top or elevation view of a zipper closure,

FIG. 2 is an enlarged longitudinal section through a tooth,

FIG. 3 is an enlarged top view of two adjacent teeth,

FIG. 4 is an enlarged vertical longitudinal section through a slider, and

Figure 5:
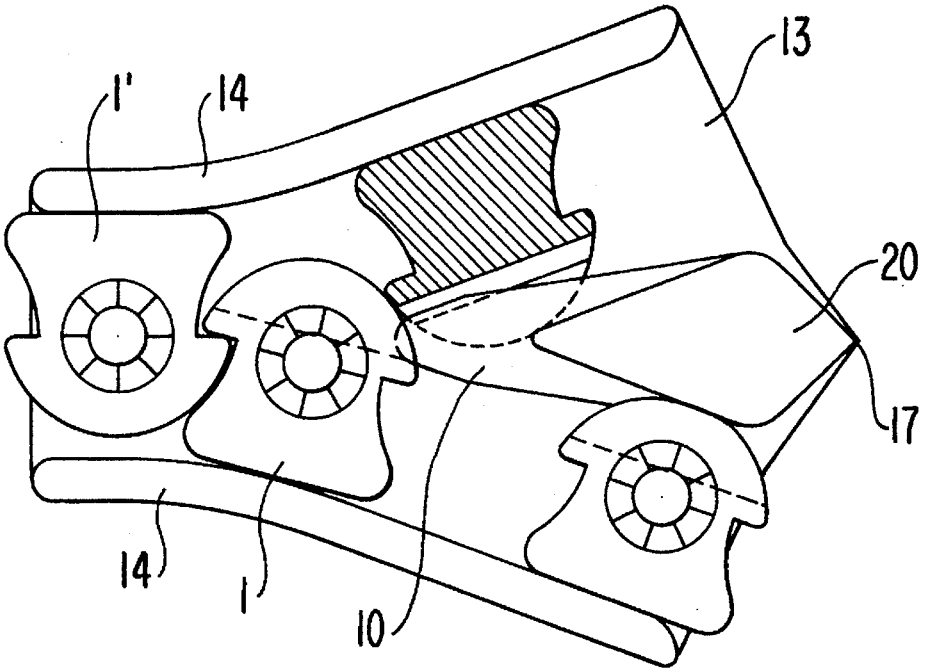
FIG. 5 is an enlarged top view of the zipper closure in which the bands on which the teeth are formed and the cover plate of the slider have been removed and in which one of the teeth is intersected through its horizontal center-plane.

FIG. 5 is an enlarged top view of the zipper closure in which the bands on which teeth are formed and a cover plate of the slider have been removed and in which one of the teeth is intersected through a horizontal center plane thereof.

DETAILED DESCRIPTION OF THE PREFERRED EMBODIMENT

The zipper closure shown in FIG. 1 comprises two bands 5,5', on which teeth 1,1' are arranged offset in the longitudinal direction. Edge beads or webs 9,9' of the bands 5,5' serve to support teeth 1, and teeth 1,1' are attached to beads or webs 9,9' by injection molding during production thereof. Decorative stones 3, for example made of lead crystal, are molded at the same time. A slider 4 typically serves to open and close the zipper closure.

As is evident from FIGS. 2 and 3, contact areas of the teeth 1,1' confronting and abutting one another in the closed position are designed prismatically, such that the areas of contact encounter no resistance to a vertical shifting of the teeth relative to one another (i.e. shifting in an direction perpendicular to the plane of FIG. 3), aside from the friction. The anchoring of the teeth 1,1' normal to the plane of the bands 5,5' results thus that channels 6,6' formed in free ends of the teeth 1,1' receive the beads or webs 9,9' of the opposing band 5,5'. So that this is possible, the teeth 1,1' must have a length which approximately corresponds to the width of the closed zipper closure. Each tooth 1,1' converges, in elevation or top view, starting from a base 11,11' to a narrowest area or portion thereof, from which support surfaces 2,2' extend outwardly nearly parallel to bands 5,5'. The free end of each tooth 1,1' has approximately the form of a half ellipse.

Decorative stones 3 can be arranged in a straight line and at a narrow spacing in comparison to their size, when the support surfaces 2,2' are kept correspondingly small, which in turn is possible due to their extension at a sharp angle to the direction of the teeth 1,1'. In the illustrated embodiment, the extension h of each support surface 2,2' in the direction of the bands 5,5' amounts to about a third of the diamater D of the decorative stones 3. In this way each decorative stone 3 is surrounded by a satisfactory amount of plastic material of the respective tooth, and still the distance between the stones 3 in a row with one another is significantly smaller than their diameter.

The slider is shown in longitudinal section in FIG. 4 and comprises top and bottom cover plates 12 and 13, respectively. Both of the side walls of the slider comprises upper and lower parts 14 and 15, respectively, which are divided by slits 16 along their full lengths. The bands 5,5' run through the slits 16, and the beads or webs 9,9' are supported by the inner surfaces of the upper and lower parts 14, 15 of the side walls. A cross-piece 20 connects the top cover plate 12 with the bottom cover plate 13.

For opening the zipper closure an outwardly directed force has to be exerted onto the teeth 1,1'. For this purpose, the cross-piece 20 is provided with a projection 10 which, having the form of a lance tip, extends beyond the end of the cross-piece 20 in the direction of the narrower end of the slider. On opening of the zipper closure this projection 10 engages in the channels 6,6' of the teeth 1,1' and in this way presses them into the tracks lying on both sides of the cross-piece 20 and extending to the wider end of the slider.

In prior art zipper closures, the end of the cross-piece 20 directed towards the wider end of the slider is formed truncated, whereby the teeth 1,1' have a considerable distance from each other at such position. In contract thereto, to allow as complete as possible closing of the zipper closure of the present invention, the end of the cross-piece 20 directed towards the wider end of the slider converges to an edge 17.

We claim:

1. A zipper closure comprising first and second rows of teeth formed on first and second bands, each said band having an edge bead or web, said teeth having free ends, each of which has a channel formed therein, such that when said zipper closure is being closed said free ends of said first row of teeth extend into an area of attachment of said teeth of said second row of teeth and vice versa, whereby said channels receive said edge beads or webs, said zipper closure further comprising a slider with a top cover plate and a bottom cover plate connected by a cross-piece, said slider having a wider front end and a narrower back end, said cross-piece having a front end directed towards said wider front end of said slider and a back end directed towards said narrower back end of said slider, said cross-piece including a tapered projection extending beyond said back end of said cross-piece and directed towards said narrower back end of said slider, whereby upon opening of said zipper closure said projection engages in said channels of said teeth and an outwardly directed force is exerted on said teeth.

2. A zipper closure comprising first and second rows of teeth formed on first and second bands, each said band including an edge bead or web, said teeth having free ends, each of which has a channel formed therein, such that when said zipper closure is being closed said free ends of said first row of teeth extend into an area of attachment of said teeth of said second row of teeth and vice versa, whereby said channels receive said edge beads or webs, said zipper closure further comprising a slider with a top cover plate and a bottom cover plate connected by a cross-piece, said slider having a wider front end and a narrower back end, said cross-piece having a front end directed towards said wider front end of said slider and a back end directed towards said narrower back end of said slider, said front end of said cross-piece directed towards said wider front end of said slider converging to an edge.

* * * * *